United States Patent [19]

Heichberger

[11] Patent Number: 4,572,728

[45] **Date of Patent: * Feb. 25, 1986**

[54] LIQUID/GAS CARBON DIOXIDE EVAPORATOR

[76] Inventor: Albert N. Heichberger, P.O. Box 16562, Jacksonville, Fla. 32245

[ * ] Notice: The portion of the term of this patent subsequent to Feb. 12, 2002 has been disclaimed.

[21] Appl. No.: 568,717

[22] Filed: Jan. 6, 1984

Related U.S. Application Data

[63] Continuation-in-part of Ser. No. 511,270, Jul. 6, 1983, Pat. No. 4,498,303.

[51] Int. Cl.[4] ..... F25J 1/00

[52] U.S. Cl. ..... 62/21; 62/37; 62/54

[58] Field of Search ..... 62/9, 11, 10, 21, 36, 62/37, 45, 54, 56, 37

[56] References Cited

U.S. PATENT DOCUMENTS 2,608,838 9/1952 Rupp ..... 62/10

3,660,985 5/1972 Tyree ..... 62/10

*Primary Examiner*—Frank Sever

*Attorney, Agent, or Firm*—Jones & Askew

[57] ABSTRACT

There is provided a process for liquefying a flow of relatively impure carbon dioxide gas in conjunction with providing a carbonation flow of relatively pure carbon dioxide gas, which includes the steps of condensing a source flow of carbon dioxide gas, containing contaminating gas having a substantially lower condensation temperature, by passing the source flow in heat exchange relation with a coolant flow of relatively pure carbon dioxide liquid while flashing the coolant flow at a selectively reduced pressure to maintain said heat exchange relation; then separating contaminating gases from the condensed source flow; and then merging the condensed source flow into said liquid coolant flow. Apparatus for practicing the process is also provided.

22 Claims, 1 Drawing Figure

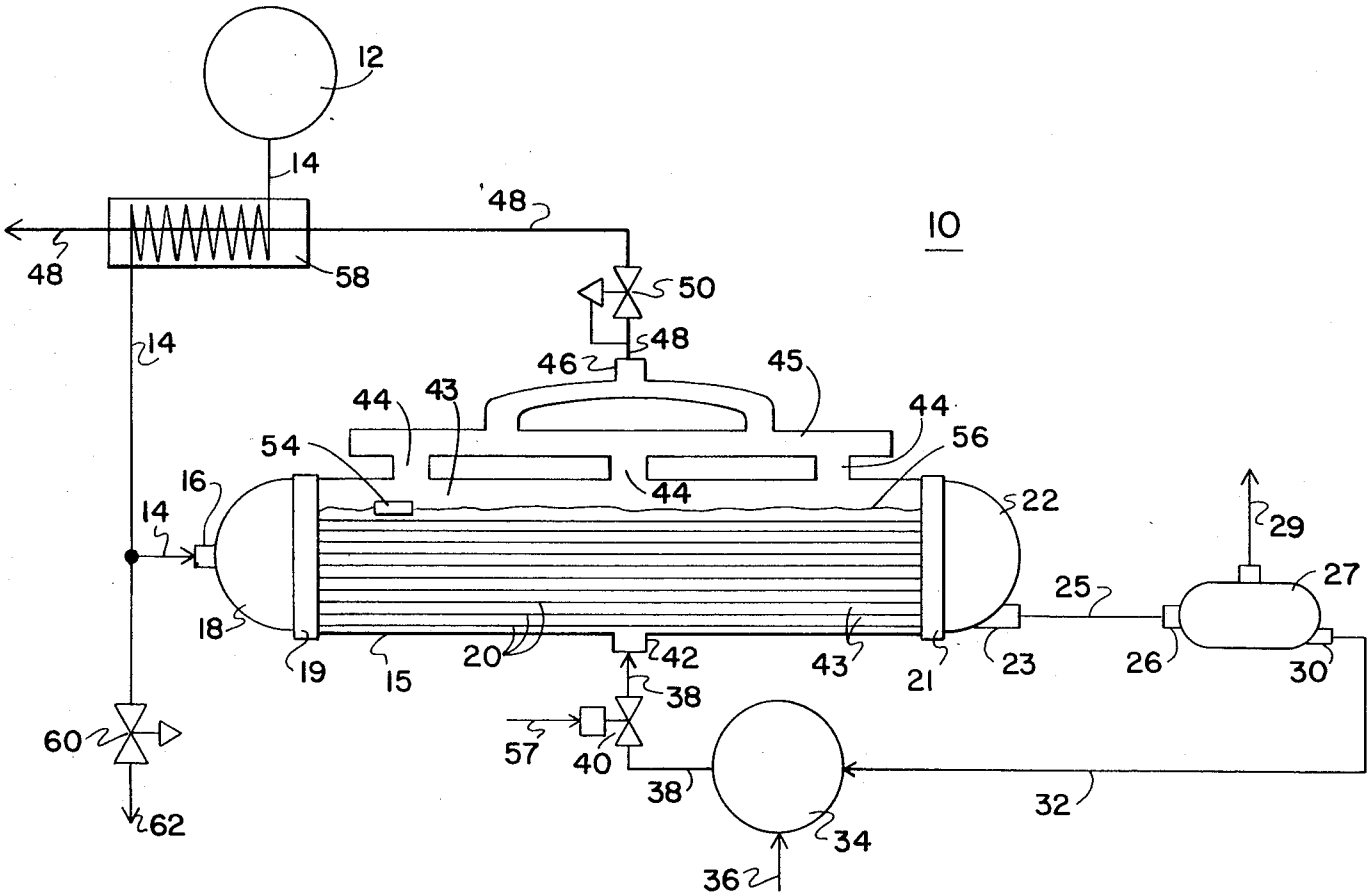
10
12
14
14
14
15
16
18
19
20
21
22
23
25
26
27
29
30
32
34
36
38
38
40
42
43
43
44
44
44
45
46
48
48
48
50
54
56
57
58
60
62

LIQUID/GAS CARBON DIOXIDE EVAPORATOR

CROSS REFERENCE TO RELATED APPLICATION

This is a continuation-in-part of U.S. application Ser. No. 511,270 filed July 6, 1983 now U.S. Pat. No. 4,498,303, the disclosure of which is incorporated herein by reference.

BACKGROUND OF THE INVENTION

This invention relates generally to liquefaction and evaporation of carbon dioxide and relates more particularly to a process and apparatus for liquefying a flow of relatively impure carbon dioxide gas in conjunction with providing a carbonation flow of relatively pure carbon dioxide gas.

Liquefied carbon dioxide has many applications, but is particularly useful in the beverage industry for carbonating beverages, such as beer and soft drinks. However, for the carbon dioxide to be of maximum usefulness, it must be relatively pure, i.e. free of contaminating gas such as oxygen and to a lesser extent nitrogen. If the carbon dioxide contains a significant amount of oxygen, the beverage in which it is used will be subject to oxidation and spoilage.

Various methods of liquefying gaseous carbon dioxide are well known. Typically, the liquefaction proccess comprises compressing the gaseous carbon dioxide to a pressure above atmospheric pressure and then removing the latent heat of vaporization to condense the compressed gas. In this way, although the sublimation temperature of solid carbon dioxide is approximately −109° F. at STP, the compressed gaseous carbon dioxide can be condensed at much higher temperatures. The theoretical range of pressures over which gaseous carbon dioxide can be condensed to a liquid is approximately 60.45 to 1057.4 psig. Typically, such commercial processes processes operate in the range of approximately 225 to 300 psig. In this range, the temperature at which gaseous carbon dioxide will condense is −14° F. at 225.25 psig and −8° F. at 251.96 psig.

Since the carbon dioxide gas also contains contaminating gas with a lower temperature of condensation, and a different latent heat of vaporization, the contaminating gas requires a lower temperature and a different amount of heat removal to condense than does the carbon dioxide gas. Therefore, the carbon dioxide will condense before admixed contaminating gases, such as oxygen and nitrogen, will condense. The contaminating gas will therefore remain in a gaseous state, whereas the carbon dioxide will liquefy.

In typical liquefaction apparatus, gaseous carbon dioxide is passed through a tube which is surrounded by a refrigerant. The carbon dioxide condenses on the inside of the tube and collects in the bottom thereof. The temperature of the refrigerant must therefore be below the condensation temperature of carbon dioxide, but greater than the condensation temperature of the contaminating gas. The contaminating gas bubble is permitted to float to the top of the liquid carbon dioxide where it collects in a gas separation chamber.

In typical use, a supply of relatively pure liquid carbon dioxide obtained as above is vaporized and directed to a beverage carbonation process. Disadvantages result from the conventional approach of carrying out separately the liquefaction and evaporation processes in terms of the number of processing steps, energy requirements and the extent of apparatus required.

SUMMARY OF THE INVENTION

It is a key object of the invention to provide a process for liquefaction of carbon dioxide in a carbonation system.

It is another key object of the invention to provide a unitary system for the production of a carbonation stream directly from a source of relatively impure carbon dioxide gas.

By providing such a unitary system, the invention eliminates need for intermediate conventional refrigeration apparatus during liquefaction of carbon dioxide gas by utilizing as a refrigerant evaporating liquid carbon dioxide in a carbonation process. Advantageously, the carbon dioxide, after liquefaction and separation from noncondensed contaminating gases, is merged into the evaporating liquid carbon dioxide acting as a refrigerant. Thus, a relatively pure carbonation stream is provided directly from a source of relatively impure carbon dioxide gas.

Broadly, in the process aspects of the invention, there is proviced a process for liquefying carbon dioxide gas, which comprises passing a source flow of carbon dioxide gas in heat exchange relation with a coolant flow of liquid carbon dioxide while flashing said coolant flow to maintain said heat exchange relation.

In an especially advantageous mode, the process is adpated for liquefying a flow of relatively impure carbon dioxide gas in conjunction with providing a carbonation flow of relatively pure carbon dioxide gas, and comprises condensing a source flow of carbon dioxide gas, containing contaminating gas having a substantially lower condensation temperature, by passing the source flow in heat exchange relation with a coolant flow of relatively pure carbon dioxide liquid while flashing the coolant flow at a selectively reduced pressure to maintain said heat exchange relation' separating contaminating gases from the condensed source flow' and then merging the condensed source flow into the liquid coolant flow.

Advantageously, the method further included regulating the flashed coolant flow to substantially maintain said selectively reduced pressure, and regulating the liquid coolant flow during said flashing in response to the rate of heat exchange.

Broadly, in the apparatus aspects of the invention, there is provided apparatus for liquefying carbon dioxide gas, comprising a heat exchanger with the inlet of its hot path being adapted to receive a flow of carbon dioxide gas, and with the inlet of its cold path being adapted to receive a flow of liquid dioxide; and means for operating the cold path of said exchanger as a carbon dioxide flash chamber.

In an especially advantageous embodiment, the apparatus is adapted for liquefying a flow of relatively impure carbon dioxide gas in conjunction with providing a carbonation flow of relatively pure carbon dioxide gas, and comprises (a) a high pressure reservoir adapted to hold liquid carbon dioxide; (b) a heat exchanger with the inlet of its hot path being adapted to receive a flow of carbon dioxide gas containing contaminating gas having a substantially lower condensation temperature than that of carbon dioxide, and with the inlet of its cold path being in flow communication with said reservoir; (c) means for selecting a relatively reduced pressure in the cold path of said exchanger during operation such that said cold path functions as a flash chamber; and (d) a gas/liquid separator, adapted to separate entrained gas from a flow of condensed carbon dioxide, with its inlet being in flow communication with the outlet of the hot path of said exchanger, and with its liquid outlet being in flow communication with said reservoir.

Preferably, the apparatus includes means for preliminarily cooling flow to said hot path inlet by passing said flow in heat exchange relation with the flashed flow from the cold path outlet during operation, and means for controlling flow to the hot path inlet in response to flow from the cold path outlet.

BRIEF DESCRIPTION OF DRAWING

Further details are given below with reference to the drawing which shows a preferred embodiment of the invention for conversion of a flow of relatively impure carbon dioxide gas to a carbonation flow.

DESCRIPTION OF THE PREFERRED EMBODIMENTS

In the drawing, there is shown a preferred embodiment 10 of the invention wherein a flow of relatively impure carbon dioxide gas is liquefied in conjunction with providing a carbonation flow of relatively pure carbon dioxide gas. At 12, there is indicated a source of relatively impure carbon dioxide gas containing a minor amount of contaminating gases, such as oxygen and nitrogen, having substantially lower condensation temperatures than that of carbon dioxide. The embodiment 10 will typically be used to advantage in a brewery carbonation process so that source 12 is continuously replenished by off gas from fermentation tanks (not shown). Source 12 is in flow communication along line 14 with hot path inlet 16 of heat exchanger 15, which preferably is a shell and tube heat exchanger of conventional design. The type of heat exchanger is not critical provided that heat exchange is noncontacting, i.e. the hot path flow does not directly contract the cold path flow. The hot path consists of plenum 18, header 19, tubes 20, header 21, plenum 22, and outlet 23. In general, whether the cold path is on the shell or in the tube side is not critical. The outlet 23 of the hot path is in flow communication along line 25 with inlet 26 to vapor/liquid separator 27 of conventional design. The source flow of carbon dioxide gas at hot inlet 16 preferably will be at a temperature of about 35° F. and a pressure of about 234 psig, as further discussed below.

As the source flow passes through the hot path of the exchanger 15, the carbon dioxide gas will be condensed such that at outlet 23 of the hot path a flow of liquid carbon dioxide will exit, which is directed to conventional gas/liquid separator 27 via line 25. Preferably, the carbon dioxide liquid at hot path outlet 23 will be substantially at a saturated liquid condition which at a pressure of about 234 psig (ignoring line pressure losses through the exchanger hot path) corresponds to about −12° F. Flow along line 25 will contain contaminating gases having a condensation temperature substantially lower than that achieved at hot path outlet 23 which may be readily separated from the condensed carbon dioxide in separator 27. Collected contaminating gas is taken off at 29 from the separator and the relatively pure carbon dioxide liquid is taken off at the separated liquid outlet 30 of separator 27 being in flow communication along line 32 with reservoir 34. Thus, reservoir 34 contains relatively pure carbon dioxide liquid that is at a saturated liquid condition, being the most efficient initial condition for operation of the flash chamber, i.e. the exchanger cold path, since the source flow must substantially match the coolant flow in steady state operation in the situation where feedback of condensed source flow replenishes coolant flow. Therefore, typical operation of the exchanger occurs under conditions such that liquefied flow at the hot path exit is substantially at a saturated liquid condition corresponding to initial conditions in the cold path/flash chamber.

Reservoir 34 is in flow communication along line 38 with the shell side 43 of exchanger 15, with flow along line 38 being regulated by solenoid valve 40. Make-up line 36 is discussed below. Thus, saturated liquid carbon dioxide is introduced into the exchanger cold path which consists of inlet 42, shell 43, vents 44, accumulator 45 and outlet 46. The cold path of the exchanger is operated essentially as a flash chamber under selectively reduced pressure, relative to that in reservoir 34, such that as saturated liquid enters the reduced pressure environment of the cold path vigorous evaporation of the liquid takes place. This condition provides two key advantages. First, a highly efficient heat transfer condition is established. Second, a substantially uniform cold path temperation may be selected by control of the flashing pressure.

Representatively, the liquid carbon dioxide from reservoir 34 will have initial saturated liquid conditions of about −12° F. at about 234 psig whereas once inside of the cold path of the exchanger a substantially reduced pressure, preferably about 170 psig, will cause a temperature to result of about −28° F. due to evaporative cooling during flashing. The term "flash" and similar terms as used herein are intended to refer to vaporization of a volatile liquid by sudden reduction in pressure corresponding to superheated liquid conditions. The liquid level 56 inside the shell 43 is preferably maintained so as to cover all the tubes 20. Above liquid level 56, vaporized carbon dioxide is vented at 44 to conventional accumulator 45 to separate entrained liquid droplets from the flashed vapor. At cold path outlet 46 the flashed flow is directed from accumulator 45 along line 48 to a conventional brewery carbonation process (not shown) subject to conventional flow regulator 50 which regulates the flow in line 48 to substantially maintain selected pressure and flashing conditions in the exchanger cold path.

In operation of system 10, regulator 50 provides a direct method of controlling the cold path temperature in exchanger 15 and therefore provides a way of controlling the rate of heat exchange between the hot and cold paths in the exchanger. The lower the pressure in the cold path, the more vigorous the rate of evaporation or flashing, and the lower the temperature achieved in the shell liquid. The liquid level 56 inside the shell is monitored by conventional level sensor 54 which in turn is in communication via 57 with solenoid valve 40 such that when level 56 drops below a predetermined minimum level, velve 40 is signaled to increase coolant flow along line 38. Conversely, if liquid level 56 rises above a predetermined maximum level, then valve 40 reduces flow along line 38.

It will be noted that under representative operating conditions carbonation flow along line 48 will be at a temperature of about −28° F., whereas a preferred temperature in a brewery carbonation process is about 35° F. Offgas from fermentation tanks as discussed above in connection with source 12 typically will be at about 110° F. whereas a preferred exchanger inlet temperature for the source gas is about 35° F. Thus, it is preferred to preliminarily cool the source gas coming from the fermentation tanks by passing the source gas in heat exchange relation at exchanger 58 with the carbonation flow. Alternatively, precooling may be accomplished by passing the source gas in heat exchange relation with the exterior surface of exchanger 15.

The system 10, it will be noted, is inherently input following, i.e. the carbonation flow output along line 48 will generally follow changes or perturbations in the source flow in line 14. However, in many cases the source flow of impure carbon dioxide gas will be substantially constant over time in a commercial scale brewery operation whereas carbonation requirements may vary considerably over time due to interruptions in the associated beverage packaging operation. A preferred way of accommodating such reduced demand for a carbonation flow is to provide a solenoid valve 60 on inlet line 14 such that when pressure increases in line 48 or line 14 due to diminished carbonation requirements source flow is diverted at 62 to a standby condensor whereby the excess source flow is condensed using a conventional refrigeration system (not shown) and the liquefied carbon dioxide which results is stored for other industrial uses. The standby condensor utilizes a conventional closed refrigeration cycle.

Optionally, a make-up flow of relatively pure liquid carbon dioxide may be provided along line 36 to reservoir 34. A preferred make-up source is fully described in my prior application referenced above.

Optionally, when the source gas is of acceptable purity, separator 27 may be eliminated.

Optionally, reservoir 34 may be of sufficient capacity to accommodate variation in carbonation flow demand. In other words, the reservoir may serve as a buffer so that source flow may be maintained substantially constant while carbonation flow undergoes oscillations depending on carbonation useage.

Although the present invention has been described in conjunction with preferred embodiments, it is to be understood that modifications and variations may be utilized without departing from the principles and scope of the invention as defined by the following claims.

I claim:

1. A process for condensing a source flow of carbon dioxide gas in conjunction with evaporating a carbonation flow of carbon dioxide gas, which comprises eliminating the necessity for evaporating said carbonation flow and for condensing said source flow by separate means including passing a source flow of carbon dioxide gas in indirect heat exchange relation with a coolant flow of liquid carbon dioxide while flashing said coolant flow at a selectively reduced pressure to maintain said heat exchange relation;

directing the condensed source flow into a reservoir of liquid carbon dioxide;

providing said coolant flow of liquid carbon dioxide from said reservoir; and simultaneously using the flashed coolant flow as a carbonation flow.

2. The process of claim 1 further comprising regulating the flashed coolant flow to maintain said selectively reduced pressure in said coolant flow so as to control the temperature of flashing.

3. The process of claim 1 wherein said coolant flow is flashed from temperature and pressure initial conditions corresponding substantially to a saturated liquid condition.

4. The process of claim 3 wherein said temperature and pressure initial conditions are selected in the respective ranges of about −14° to −8° F. and about 225 to 252 psig.

5. The process of claim 3 wherein said source flow is condensed to a substantially saturated liquid condition.

6. The process of claim 5 wherein the temperature and pressure of the condensed source flow is about equal to said initial conditions of said coolant flow.

7. The process of claim 1 further comprising regulating the liquid coolant flow during said flashing in response to the rate of heat exchange.

8. The process of claim 1 further comprising controlling said source flow in response to a demand signal for flashed coolant flow.

9. The process of claim 8 further comprising diverting said source gas flow, in response to substantially reduced demand for carbonation flow, to closed refrigeration cycle condensing, and merging the condensed source flow therefrom into said reservoir.

10. The process of claim 1 further comprising separating entrained liquid from the flashed coolant flow.

11. The process of claim 1 further comprising preliminarily cooling said source flow prior to said condensing by passing said source flow in heat exchange relation with the flashed coolant flow.

12. The process of claim 1 wherein said source flow is provided from a fermentation process and said carbonation flow is directed to a beverage carbonation process.

13. The process of claim 1 further comprising separating noncondensed gases from the condensed source flow prior to merging the condensed source flow into said reservoir.

14. Apparatus for condensing a source flow of carbon dioxide gas in conjunction with evaporating a carbonation flow of carbon dioxide gas, which comprises means designed for eliminating the necessity for separate means for evaporating said carbonation flow and for condensing said source flow including a high pressure reservoir configured to hold liquid carbon dioxide;

a heat exchanger operative for condensing carbon dioxide source gas in its hot path, and for flashing carbon dioxide liquid to a carbonation flow in its cold path, and configured with the inlet of its hot path in flow communication with a source flow of carbon dioxide gas;

with the inlet of its cold path in flow communication with said reservoir to receive a coolant flow of liquid carbon dioxide therefrom;

with the outlet of its hot path in flow communication with said reservoir to direct condensed source flow thereto; and with the outlet of its cold path in flow communication with a carbonation flow to provide flashed coolant flow thereto; and control means for controlling relatively reduced and selected pressure in said cold path during operation such that said cold path functions as a flash chamber at selected temperature.

15. The apparatus of claim 14 further comprising means for regulating the flow from said reservoir to said cold path inlet in response to the rate of heat exchange during operation.

16. The apparatus of claim 14 further comprising means for controlling flow to the hot path inlet in response to flow from the cold path outlet.

17. The apparatus of claim 14 further comprising means for separating entrained liquid from flashed flow in said cold path during operation.

18. The apparatus of claim 14 further comprising means for preliminarily cooling flow to said hot path inlet during operation by passing said flow in heat exchange relation with the flashed flow from the cold path outlet.

19. The apparatus of claim 14 wherein said control means comprise means for regulating the flashed coolant flow to maintain said selectively reduced pressure in said coolant flow so as to control the temperature of flashing.

20. The apparatus of claim 14 wherein the inlet of said hot path is in flow communication with a source flow of carbon dioxide gas from a fermentation process; and the outlet of said cold path is in flow communication with a beverage carbonation process to direct flashed coolant flow thereto.

21. The apparatus of claim 14 further comprising in combination, a closed refrigeration cycle condenser in parallel flow relation with said apparatus such that its hot path inlet is in flow communication with said source flow and its hot path outlet is in flow communication with said reservoir; and flow regulator means for diverting source gas flow thereto in response to substantially reduced demand for carbonation flow.

22. The apparatus of claim 14 further comprising a gas/liquid separator operative to separate entrained gas from said condensed source gas, and configured with its inlet a flow communication with the outlet of said hot path and with its liquid outlet in flow communication with said reservoir.

* * * * *